US008105991B2

(12) United States Patent
Dowding et al.

(10) Patent No.: US 8,105,991 B2
(45) Date of Patent: Jan. 31, 2012

(54) OVERBASED METAL SULPHONATE DETERGENT

(75) Inventors: Peter J. Dowding, Wantage (GB); Christopher J. Adams, Reading (GB)

(73) Assignee: Infineum International Ltd. (GB)

( * ) Notice: Subject to any disclaimer, the term of this patent is extended or adjusted under 35 U.S.C. 154(b) by 520 days.

(21) Appl. No.: 12/243,160

(22) Filed: Oct. 1, 2008

(65) Prior Publication Data

US 2009/0093386 A1 Apr. 9, 2009

(30) Foreign Application Priority Data

Oct. 4, 2007 (EP) ..... 07117914

(51) Int. Cl.
*C10M 159/24* (2006.01)

(52) U.S. Cl. ..... 508/391; 508/542; 508/543

(58) Field of Classification Search ..... 508/391, 508/542, 543
See application file for complete search history.

(56) References Cited

U.S. PATENT DOCUMENTS

| | | | | |
|---|---|---|---|---|
| 3,429,811 | A | 2/1969 | Robbins et al. | |
| 3,928,216 | A | 12/1975 | Saunders et al. | |
| 5,143,633 | A * | 9/1992 | Gallo et al. | 508/396 |
| 2007/0015672 | A1 | 1/2007 | Adams et al. | |

FOREIGN PATENT DOCUMENTS

| | | | |
|---|---|---|---|
| EP | 0323087 | A1 | 7/1989 |
| EP | 1018539 | A2 | 7/2000 |
| GB | 1513441 | A | 6/1978 |
| WO | WO 97/46644 | | 12/1997 |

* cited by examiner

*Primary Examiner* — Walter D Griffin
*Assistant Examiner* — Vishal Vasisth

(57) ABSTRACT

An overbased metal sulphonate detergent having incorporated therein at least one friction modifier including at least one amine group.

16 Claims, No Drawings

OVERBASED METAL SULPHONATE DETERGENT

This invention relates to an overbased metal sulphonate detergent.

Currently there is a drive in terms of fuel economy for gasoline and diesel engines, which has resulted in increased levels of organic friction modifiers being used in lubricating oil compositions; unfortunately, there are compatibility issues between the friction modifiers and overbased metal sulphonate detergents, which are currently resolved by the use of a two-part package, with the friction modifier being added as a top-treat. The present invention is therefore concerned with overcoming the compatibility issues between friction modifiers and overbased metal sulphonate detergents in lubricating oil compositions.

In accordance with the present invention, there is provided an overbased metal sulphonate detergent comprising at least one friction modifier having at least one amine group. The friction modifier having at least one amine group is hereinafter known as 'amine-based friction modifier'. The overbased metal sulphonate detergent is manufactured in the presence of the amine-based friction modifier so that the friction modifier is incorporated into the detergent.

Friction modifiers are generally long, slender molecules added to lubricants for the purpose of minimizing light surface contacts. They have a polar end (head) and an oil-soluble end (tail). The tail is normally a straight hydrocarbon chain including at least 10 carbon atoms, preferably 10-40 carbon atoms, more preferably 12-25 carbon atoms, and even more preferably 15-19 carbon atoms. If the tail is too long or too short, the molecule will not function as a friction modifier. In use, the heads attach to a metal surface and the tails stack side by side.

The amine-based friction modifier is preferably selected from: alkoxylated hydrocarbyl-substituted mono-amines and diamines, and hydrocarbyl ether amines; preferably from alkoxylated tallow amines and alkoxylated tallow ether amines; with alkoxylated amines containing about two moles of alkylene oxide per mole of nitrogen being the most preferred. Ethoxylated amines and ethoxylated ether amines are especially preferred. Such friction modifiers preferably include linear hydrocarbyl groups. Hydrocarbyl groups are predominantly composed of carbon and hydrogen but may contain one or more hetero atoms such as sulphur or oxygen. Preferred hydrocarbyl groups range from 12-25 carbon atoms, preferably 15-19 carbon atoms. Preferred structures are illustrated by (but not limited to) the two figures below:

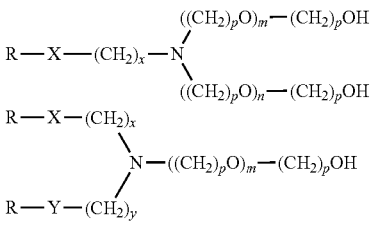

wherein R is a $C_6$ to $C_{28}$ alkyl group, preferably a $C_{12}$ to $C_{25}$ alkyl group, X and Y are independently O or S or $CH_2$, x and y are independently 1 to 6, p is 2 to 4 (preferably 2), and m and n are independently 0 to 5. The alkyl group or groups are sufficiently linear in character to impart friction modifier properties.

In the present invention, the overbased metal sulphonate detergent is synthesized in the presence of the amine-based friction modifier in order to produce a hybrid system that functions as both a detergent and a friction modifier. Therefore, it may be used in a lubricating oil composition as both the detergent and the friction modifier, which means that a separate, additional friction modifier may not be required.

The amine-based friction modifier is preferably added to the reaction components after a "heat-soaking" step.

In accordance with the present invention, there is also provided a lubricating oil composition comprising oil of lubricating viscosity and an overbased metal sulphonate detergent comprising at least one friction modifier having at least one amine group.

In accordance with the present invention, there is also provided use in a lubricating oil composition as both a detergent and a friction modifier of an overbased metal sulphonate detergent comprising at least one friction modifier having at least one amine group.

In accordance with the present invention, there is also provided a method for preparing an overbased metal sulphonate detergent comprising at least one friction modifier having at least one amine group; the method comprising the following steps:

- providing a mixture of an alkyl arene sulphonic acid, a hydrocarbon solvent, an alcohol and a stoichiometric excess of an alkali metal or alkaline earth metal base (e.g. metal hydroxide, metal oxide, metal alkoxide and the like) above that required to react with the sulphonic acid;
- overbasing the mixture with an overbasing agent;
- "heat-soaking" the mixture; and
- adding the friction modifier having at least one amine group to the mixture following the "heat-soaking" step.

By "heat-soaking" we mean that the mixture is maintained, without addition of any further chemical reagents, in a selected temperature range (or at a selected temperature), which is preferably higher than the temperature at which carbonation is effected, for a period before any further processing steps are carried out.

In accordance with the present invention, there is also provided a method of reducing friction in an engine; the method comprising the step of lubricating the engine with a lubricating oil composition comprising oil of lubricating viscosity and an overbased metal sulphonate detergent comprising at least one friction modifier having at least one amine group.

The engine is preferably an automotive engine, especially a gasoline engine.

The alkyl arene sulphonic acid is preferably an alkylbenzene sulphonic acid. The alkali metal or alkaline earth metal base is preferably calcium hydroxide.

A detergent is an additive that reduces formation of piston deposits, for example high-temperature varnish and lacquer deposits, in engines; it normally has acid-neutralising properties and is capable of keeping finely divided solids in suspension. Most detergents are based on metal "soaps"; that is metal salts of acidic organic compounds, sometimes referred to as surfactants.

Detergents generally comprise a polar head with a long hydrophobic tail, the polar head comprising a metal salt of an acidic organic compound. Large amounts of a metal base can be included by reacting an excess of a metal base, such as an oxide or hydroxide, with an acidic gas such as carbon dioxide to give an overbased detergent which comprises neutralised detergent as the outer layer of a metal base (e.g. carbonate) micelle.

Overbased metal sulphonate detergents are preferably formed from a mixture of a sulphonic acid, a hydrocarbon solvent, an alcohol, water and a stoichiometric excess of a metallic base (preferably calcium hydroxide) above that required to react with the sulphonic acid. The mixture is overbased (carbonated) with an overbasing agent which provides a source of base. The process involves adding the reagents to a reactor and injecting the overbasing agent into the reactor until most or all of the metal compound has been carbonated. The carbonation step is followed by a "heat-soaking" step in which the mixture is maintained, without addition of any further chemical reagents, in a selected temperature range (or at a selected temperature), which is normally higher than the temperature at which carbonation is effected, for a period before any further processing steps are carried out. The amine-based friction modifier is preferably added to the overbased detergent after the "heat-soaking" step.

Examples of suitable overbasing agents are carbon dioxide, a source of boron (for example, boric acid), sulphur dioxide, hydrogen sulphide, and ammonia. Preferred overbasing agents are carbon dioxide or boric acid, or a mixture of the two. The most preferred overbasing agent is carbon dioxide and, for convenience, the treatment with overbasing agent will in general be referred to as "carbonation". Unless the context clearly requires otherwise, it will be understood that references herein to carbonation include references to treatment with other overbasing agents.

Advantageously, on completion of the carbonation step, part of the basic metal compound remains uncarbonated. Advantageously, up to 15 mass % of the basic calcium compound remains uncarbonated, especially up to 11 mass %.

Carbonation is effected at less than 100° C. Typically the carbonation is effected at least 15° C., preferably at least 25° C. Advantageously, carbonation is carried out at less than 80° C., more advantageously less than 60° C., preferably at most 50° C., more preferably at most 40° C., and especially at most 35° C.

Advantageously, the temperature is maintained substantially constant during the carbonation step, with only minor fluctuations. Where there is more than one carbonation step, both or all carbonation steps are preferably carried out at substantially the same temperature, although different temperatures may be used, if desired, provided that each step is carried out at less than 100° C.

Carbonation may be effected at atmospheric, super-atmospheric or sub-atmospheric pressures. Preferably, carbonation is carried out at atmospheric pressure.

The carbonation step is followed by a "heat-soaking" step in which the mixture is maintained, without addition of any further chemical reagents, in a selected temperature range (or at a selected temperature), which is normally higher than the temperature at which carbonation is effected, for a period before any further processing steps are carried out. The mixture is normally stirred during heat-soaking. Typically, heat-soaking may be carried out for a period of at least 30 minutes, advantageously at least 45 minutes, preferably at least 60 minutes, especially at least 90 minutes. Temperatures at which heat-soaking may be carried out are typically in the range of from 15° C. to just below the reflux temperature of the reaction mixture, preferably 25° C. to 60° C.: the temperature should be such that substantially no materials (for example, solvents) are removed from the system during the heat-soaking step. We have found that heat-soaking has the effect of assisting product stabilization, dissolution of solids, and filterability.

The amine-based friction modifier is preferably added to the detergent after the heat-soaking step.

If highly overbased products are required, following the carbonation step (and the heat-soaking step, if used), a further quantity of basic calcium compound is advantageously added to the mixture and the mixture is again carbonated, the second carbonation step advantageously being followed by a further heat-soaking step.

Products of reduced viscosity may be obtained by employing one or more further additions of basic calcium compound and subsequent carbonation, each carbonation step advantageously being followed by a heat-soaking step.

Basic metal compounds include metal oxides, hydroxides, alkoxides, and carboxylates. Calcium oxide and, more especially, hydroxide are preferably used. A mixture of basic compounds may be used, if desired.

The mixture to be overbased by the overbasing agents should normally contain water, and may also contain one or more solvents, promoters (such as alkanols, preferably methanol) or other substances commonly used in overbasing processes.

Examples of suitable solvents are aromatic solvents, for example, benzene, alkyl-substituted benzenes, for example, toluene or xylene, halogen-substituted benzenes, and lower alcohols (with up to 8 carbon atoms). Preferred solvents are toluene and/or methanol. The amount of toluene used is advantageously such that the percentage by mass of toluene, based on the metal overbased detergent (excluding oil) is at least 1.5, preferably at least 15, more preferably at least 45, especially at least 60, more especially at least 90. For practical/economic reasons, the said percentage of toluene is typically at most 1200, advantageously at most 600, preferably at most 500, especially at most 150. The amount of methanol used is advantageously such that the percentage by mass of methanol, based on the metal detergent (excluding oil) is at least 1.5, preferably at least 15, more preferably at least 30, especially at least 45, more especially at least 50. For practical/economic reasons, the said percentage of methanol (as solvent) is typically at most 800, advantageously at most 400, preferably at most 200, especially at most 100. The above percentages apply whether the toluene and methanol are used together or separately.

Preferred promoters are methanol and water. The amount of methanol used is advantageously such that the percentage by mass of methanol, based on the initial charge of basic metal compound(s), for example, calcium hydroxide (that is, excluding any basic metal compound(s) added in a second or subsequent step) is at least 6, preferably at least 60, more preferably at least 120, especially at least 180, more especially at least 210. For practical/economic reasons, the said percentage of methanol (as promoter) is typically at most 3200, advantageously at most 1600, preferably at most 800, especially at most 400. The amount of water in the initial reaction mixture (prior to treatment with the overbasing agent) is advantageously such that the percentage by mass of water, based on the initial charge of basic metal compound(s), for example, calcium hydroxide, (that is, excluding any basic metal compound(s) added in a second or subsequent step) is at least 0.1, preferably at least 1, more preferably at least 3, especially at least 6, more especially at least 12, particularly at least 20. For practical/economic reasons, the said percentage of water is typically at most 320, advantageously at most 160, preferably at most 80, especially at most 40. If reactants used are not anhydrous, the proportion of water in the reaction mixture should take account of any water in the components and also water formed by neutralization of the surfactants. In particular, allowance must be made for any water present in the surfactants themselves.

Advantageously, the reaction medium comprises methanol, water (at least part of which may be generated during salt formation), and toluene.

If desired, low molecular weight carboxylic acids (with 1 to about 7 carbon atoms), for example, formic acid, inorganic halides, or ammonium compounds may be used to facilitate carbonation, to improve filterability, or as viscosity agents for overbased detergents. However, the overbased detergents are preferably free from inorganic halides, ammonium salts, dihydric alcohols or residues thereof.

For ease of handling, the overbased detergent advantageously has a $KV_{40}$ of at most 20,000 $m^2/s$, preferably at most 10,000 $mm^2/s$, especially at most 5,000 $mm^2/s$, and a $KV_{100}$ of at most 2,000 $mm^2/s$, preferably at most 1,000 $mm^2/s$, especially at most 500 $mm^2/s$. Throughout this specification, viscosities are measured in accordance with ASTM4 D445.

The basicity of the detergent is preferably expressed as a total base number (TBN). A total base number is the amount of acid needed to neutralize all of the basicity of the overbased material. The TBN may be measured using ASTM standard D2896 or an equivalent procedure. The detergent may have a low TBN (i.e. a TBN of less than 50), a medium TBN (i.e. a TBN of 50 to 150) or a high TBN (i.e. a TBN of greater than 150, such as 150-500). Preferred detergents according to the invention have a TBN of greater than 150.

Sulphonic acids are typically obtained by sulphonation of hydrocarbyl-substituted, especially alkyl-substituted, aromatic hydrocarbons, for example, those obtained from the fractionation of petroleum by distillation and/or extraction, or by the alkylation of aromatic hydrocarbons. Examples include those obtained by alkylating benzene, toluene, xylene, naphthalene, biphenyl or their halogen derivatives, for example, chlorobenzene, chlorotoluene or chloronaphthalene. Alkylation of aromatic hydrocarbons may be carried out in the presence of a catalyst with alkylating agents having from about 3 to more than 100 carbon atoms, such as, for example, haloparaffins, olefins that may be obtained by dehydrogenation of paraffins, and polyolefins, for example, polymers of ethylene, propylene, and/or butene. The alkylaryl sulphonic acids usually contain from about 7 to about 100 or more carbon atoms. They preferably contain from about 16 to about 80 carbon atoms, or 12 to 40 carbon atoms, per alkyl-substituted aromatic moiety, depending on the source from which they are obtained.

When neutralizing these alkylaryl sulphonic acids to provide sulphonates, hydrocarbon solvents and/or diluent oils may also be included in the reaction mixture, as well as promoters and viscosity control agents.

Another type of sulphonic acid which may be used comprises alkyl phenol sulphonic acids. Such sulphonic acids can be sulphurized. Whether sulphurized or non-sulphurized these sulphonic acids are believed to have surfactant properties comparable to those of sulphonic acids, rather than surfactant properties comparable to those of phenols.

Sulphonic acids suitable for use in accordance with the invention also include alkyl sulphonic acids. In such compounds the alkyl group suitably contains 9 to 100 carbon atoms, advantageously 12 to 80 carbon atoms, especially 16 to 60 carbon atoms.

Where a surfactant is used in the form of a salt, any suitable cation may be present, for example, a quaternary nitrogenous ion, or, preferably, a metal ion. Suitable metal ions include those of alkali metals, alkaline earth metals (including magnesium) and transition metals. Examples of suitable metals are lithium, potassium, sodium, magnesium, calcium, barium, copper, zinc, and molybdenum. Preferred metals are lithium, potassium, sodium, magnesium and calcium, more preferably lithium, sodium, magnesium and calcium, especially calcium. Neutralization of surfactants may be effected before addition of the basic calcium compound used in the overbasing step or by means of the basic calcium compound.

Overbased detergents, which are normally prepared as concentrates in oil containing, for example, 50 to 70 mass % overbased detergent based on the mass of the concentrate, are useful as additives for oil-based compositions, for example, lubricants or greases. The amount of overbased detergent to be included in the oil-based composition depends on the type of composition and its proposed application: lubricants for marine applications typically contain 0.5 to 18 mass % of overbased detergent, on an active ingredient basis based on the final lubricant, while automotive crankcase lubricating oils typically contain 0.01 to 6 mass % of overbased detergent, on an active ingredient basis based on the final lubricant.

The overbased detergents prepared are oil-soluble or are dissolvable in oil with the aid of a suitable solvent, or are stably dispersible materials. Oil-soluble, dissolvable, or stably dispersible as that terminology is used herein does not necessarily indicate that the additives are soluble, dissolvable, miscible, or capable of being suspended in oil in all proportions. It does mean, however, that the additives are, for instance, soluble or stably dispersible in oil to an extent sufficient to exert their intended effect in the environment in which the oil is employed. Moreover, the incorporation in an oil-based composition of other additives may permit incorporation of higher levels of a particular additive, if desired.

The overbased detergents may be incorporated into a base oil in any convenient way. Thus, they may be added directly to the oil by dispersing or by dissolving them in the oil at the desired level of concentration, optionally with the aid of a suitable solvent such, for example, as toluene or cyclohexane. Such blending can occur at room temperature or at elevated temperature.

The detergent may also contain a further surfactant group, such as groups selected from: phenol, salicylic acid, carboxylic acid and naphthenic acid, that may be obtained by manufacture of a hybrid material in which two or more different surfactant groups are incorporated during the overbasing process.

Examples of hybrid materials are an overbased calcium salt of surfactants sulphonic acid and phenol; an overbased calcium salt of surfactants sulphonic acid and salicylic acid; an overbased calcium salt of surfactants sulphonic acid and carboxylic acid; and an overbased calcium salt of surfactants salicylic acid, phenol and sulphonic acid.

In the instance where at least two overbased metal compounds are present, any suitable proportions by mass may be used, preferably the mass to mass proportion of any one overbased metal compound to any other metal overbased compound is in the range of from 5:95 to 95:5; such as from 90:10 to 10:90; more preferably from 20:80 to 80:20; especially from 70:30 to 30:70; advantageously from 60:40 to 40:60.

Particular examples of hybrid materials include, for example, those described in WO-A-97/46643; WO-A-97/46644; WO-A-97/46645; WO-A-97/46646; and WO-A-97/46647.

The lubricating oil composition may include at least one friction modifier, such as, for example, a friction modifier selected from: glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. As an example of such oil-soluble organo-molybdenum compounds, there may be mentioned the dithiocarbamates, dithiophosphates, dithiophosphinates, xanthates, thioxanthates, sulphides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

The molybdenum compounds may be of the formula $Mo(ROCS_2)_4$ and $Mo(RSCS_2)_4$ wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of

1 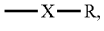

2 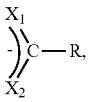

3 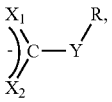

4 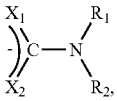

and

-continued

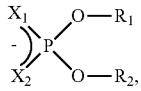

and mixtures thereof, wherein X, $X_1$, $X_2$, and Y are independently selected from the group of oxygen and sulphur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).
2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulphoxy, etc.).
3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds requires selection of ligands having the appropriate charge to balance the core's charge.

Compounds having the formula $Mo_3S_kL_nQ_z$ have cationic cores surrounded by anionic ligands and are represented by structures such as

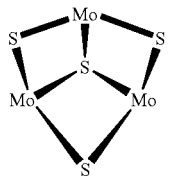

and

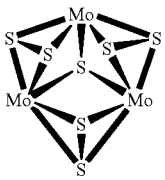

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. This includes the case of a multidentate ligand having multiple connections to a single core. It is believed that oxygen and/or selenium may be substituted for sulphur in the core(s).

Oil-soluble or dispersible trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulphide. Other oil-soluble or dispersible trinuclear molybdenum compounds can be formed during a reaction in the appropriate solvent(s) of a molybdenum source such as of $(NH_4)Mo_3S_{13}.n(H_2O)$, a ligand source such as tetralkylthiuram disulphide, dialkyldithiocarbamate, or dialkyldithiophosphate, and a sulphur abstracting agent such cyanide ions, sulphite ions, or substituted phosphines. Alternatively, a trinuclear molybdenum-sulphur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. At least 21 total carbon atoms should be present among all the ligand's organo groups. Preferably, the ligand source chosen has a sufficient number of carbon atoms in its organo groups to render the compound soluble or dispersible in the lubricating composition.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The molybdenum compound is preferably an organo-molybdenum compound. Moreover, the molybdenum compound is preferably selected from the group consisting of a molybdenum dithiocarbamate (MoDTC), molybdenum dithiophosphate, molybdenum dithiophosphinate, molybdenum xanthate, molybdenum thioxanthate, molybdenum sulphide and mixtures thereof. Most preferably, the molybdenum compound is present as molybdenum dithiocarbamate. The molybdenum compound may also be a trinuclear molybdenum compound.

The lubricating oil composition may include at least one antiwear agent or antioxidant agent. Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oils in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

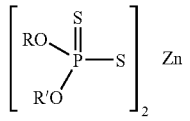

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. The present invention may be particularly useful when used with lubricant compositions containing phosphorus levels of from about 0.02 to about 0.12 wt. %, preferably from about 0.03 to about 0.10 wt. %. More preferably, the phosphorous level of the lubricating oil composition will be less than about 0.08 wt. %, such as from about 0.05 to about 0.08 wt. %.

The lubricating oil composition may include at least one oxidation inhibitor. Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, alkylphenol sulphides, oil soluble phenates and sulphurized phenates, phosphosulphurized or sulphurized hydrocarbons or esters, phosphorous esters, metal thiocarbamates, oil soluble copper compounds as described in U.S. Pat. No. 4,867,890, and molybdenum-containing compounds.

Aromatic amines having at least two aromatic groups attached directly to the nitrogen constitute another class of compounds that is frequently used for antioxidancy. They are preferably used in only small amounts, i.e., up to 0.4 wt %, or more preferably avoided altogether other than such amount as may result as an impurity from another component of the composition.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulphur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil-soluble aromatic amines having at least two aromatic groups attached directly to one amine nitrogen should preferably not exceed 0.4 wt. % active ingredient.

The lubricating oil composition may include at least one viscosity modifier. Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprenetbutadiene, as well as the partially hydrogenated homopolymers of butadiene and isoprene.

The lubricating oil composition may include at least one viscosity index improver. A viscosity index improver dispersant functions both as a viscosity index improver and as a dispersant. Examples of viscosity index improver dispersants include reaction products of amines, for example polyamines, with a hydrocarbyl-substituted mono- or dicarboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated mono-carboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralised with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine or alcohol.

The lubricating oil composition may include at least one pour point depressant. Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates. Foam control can be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

In the lubricating oil composition, it may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

When lubricating oil compositions contain one or more of the above-mentioned additives, each additive is typically blended into the base oil in an amount that enables the additive to provide its desired function. Representative effective amounts of such additives, when used in crankcase lubricants, are listed below. All the values listed are stated as mass percent active ingredient.

| ADDITIVE | MASS % (Broad) | MASS % (Preferred) |
|---|---|---|
| Metal Detergents | 0.1-15 | 0.2-9 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-2 |
| Pour Point Depressant | 0.01-5 | 0.01-1.5 |
| Antifoaming Agent | 0-5 | 0.001-0.15 |
| Supplemental Antiwear Agents | 0-1.0 | 0-0.5 |
| Friction Modifier | 0-5 | 0.01-1.5 |
| Viscosity Modifier | 0.01-10 | 0.25-3 |
| Basestock | Balance | Balance |

Preferably, the Noack volatility of the fully formulated lubricating oil composition (oil of lubricating viscosity plus all additives) will be no greater than 12, such as no greater than 10, preferably no greater than 8.

It may be desirable, although not essential, to prepare one or more additive concentrates comprising additives (concentrates sometimes being referred to as additive packages) whereby several additives can be added simultaneously to the oil to form the lubricating oil composition.

The final composition may employ from 5 to 25 mass %, preferably 5 to 18 mass typically 10 to 15 mass % of the concentrate, the remainder being oil of lubricating viscosity.

The lubricating oils may range in viscosity from light distillate mineral oils to heavy lubricating oils such as gasoline engine oils, mineral lubricating oils and heavy duty diesel oils. Generally, the viscosity of the oil ranges from about 2 $mm^2$/sec (centistokes) to about 40 $mm^2$/sec, especially from about 4 $mm^2$/sec to about 20 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service. Such re-refined oils are also known as reclaimed or reprocessed oils and are often subjected to additionally processing using techniques for removing spent additives and oil breakdown products.

The oil of lubricating viscosity may comprise a Group I, Group II, Group III, Group IV or Group V base stocks or base oil blends of the aforementioned base stocks. Preferably, the oil of lubricating viscosity is a Group III, Group IV or Group V base stock, or a mixture thereof provided that the volatility of the oil or oil blend, as measured by the Noack test (ASTM D5880), is less than or equal to 13.5%, preferably less than or equal to 12%, more preferably less than or equal to 10%, most preferably less than or equal to 8%; and a viscosity index (VI) of at least 120, preferably at least 125, most preferably from about 130 to 140.

Definitions for the base stocks and base oils in this invention are the same as those found in the American Petroleum Institute (API) publication "engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group m base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, III, or IV.

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

The present invention will now be described by reference to the following examples; however, the present invention is not limited to the following examples:

EXAMPLES

The present invention is illustrated by but in no way limited to the following examples.

The following overbased calcium sulphonate detergents were prepared:

TABLE 1

| | |
|---|---|
| Comparative Example 1 | 300TBN Ca sulphonate detergent manufactured in presence of 7.9% glycerol monooleate (Atsurf 594, available from Uniqema). |
| Example 2 | 300TBN Ca sulphonate detergent manufactured in presence of 7.9% ethoxylated tallow amine (ETHOMEEN T/12, available from Akzo Nobel). |
| Comparative Example 3 | 300TBN Ca sulphonate detergent manufactured in presence of 7.9% oleamide (Armid O, available from Akzo Nobel. |
| Comparative Example 4 | 300TBN Ca sulphonate detergent manufactured in presence of 8.2% oleamide (Armid O, available from Akzo Nobel. In this example the initial charge of alkyl benzene sulphonic acid is reduced by the same mass % as the charge of oleamide used. |

Preparation of Overbased Calcium Sulphonate-Friction Modifier Hybrid Detergents 360.4 g toluene, 283.5 g methanol, 22.05 g water, and 24.84 g of diluent oil (Group I 150N) were introduced into a reactor and mixed while maintaining the temperature at approximately 20° C. Calcium hydroxide ($Ca(OH)_2$) (231 g) was added, and the mixture was heated to 40° C., with stirring. To the slurry obtained in this way was added 342.2 g (82% a.i., 1242 mmoles/kg) of an alkyl benzene sulphonic acid, diluted in 135 g toluene. The temperature of the mixture was reduced to approximately 28° C., and maintained at this temperature while the carbon dioxide charge (800 g) was injected into the mixture over a period of 10 minutes. The temperature was then raised to 60° C. over 1 hour to 'heat-soak' the reaction before cooling back to a temperature of approximately 28° C. At this point, friction modifier (e.g. Ethoxylated Tallow Amine Friction Modifier) was added (77.83 g) under stirring together with a further charge of diluent oil (196.2 g). To complete the synthesis, the product was heated from 60 to 160° C. in four hours to remove the solvents and water. This solvent stripping process was performed under reduced pressure in a rotary evaporator in four stages: 60-67° C. for 20 minutes, 67-72° C. for 40 minutes, 72-155° C. for and held at 155° C. for 60 minutes. The product was filtered at 150° C. to remove sediment.

The overbased calcium sulphonate detergents in Table 1 and a 300 TBN calcium sulphonate detergent were blended into the following blends:

TABLE 2

| | Blend 1 | Blend 2 | Blend 3 | Blend 4 | Blend 5 |
|---|---|---|---|---|---|
| 300 TBN Calcium Sulphonate, (available from Infineum UK Ltd) | 17.78 | — | — | — | — |
| Comparative Example 1 from Table 1 | — | 21.11 | — | — | — |
| Example 2 from Table 1 | — | — | 19.63 | — | — |
| Comparative Example 3 from Table 1 | — | — | — | 12.73 | — |
| Comparative Example 4 from Table 1 | — | — | — | — | 12.73 |
| Dispersant (available from Infineum UK Ltd) | 35.56 | 35.56 | 35.56 | 35.56 | 35.56 |
| Anti-foam (available from Infineum UK Ltd) | 0.01 | 0.01 | 0.01 | 0.01 | 0.01 |
| Aminic Anti-oxidant (Naugalube 438L, available from Chemtura) | 7.78 | 7.78 | 7.78 | 7.78 | 7.78 |
| Phenolic Anti-oxidant (AN 1216, available from Albemarle Corporation) | 8.89 | 8.89 | 8.89 | 8.89 | 8.89 |
| Molybdenum Friction Modifier (available from Infineum UK Ltd) | 4.44 | 4.44 | 4.44 | 4.44 | 4.44 |
| Ethoxylated Tallow Amine Friction Modifier, (ETHOMEEN T/12, available from Akzo Nobel) | 1.67 | 1.85 | — | 1.67 | 1.67 |
| ZDDP (available from Infineum UK Ltd) | 7.11 | 7.11 | 7.11 | 7.11 | 7.11 |
| Glycerol Monooleate Friction Modifier, (Atsurf 594, available from Uniqema) | 3.33 | — | 3.33 | 3.33 | 3.33 |
| ESN 150 Base oil | 13.43 | 13.25 | 13.25 | 18.48 | 18.48 |
| Total | 100.00 | 100.00 | 100.00 | 100.00 | 100.00 |

The blends were tested for their stability by storing them at 60° C. for 12 weeks and observing them at weekly intervals. The results refer to the number of weeks after which instability manifested itself as haze and/or sediment. A result was considered as a failure for sediment levels of >0.15%. The results are shown below.

TABLE 3

| Blends | Stability Test Result, weeks |
|---|---|
| Comparative Blend 1 | 1 |
| Comparative Blend 2 | 1 |
| Blend 3 | 10 |
| Comparative Blend 4 | 1 |
| Comparative Blend 5 | 3 |

As shown above in Table 3, Blend 3 produces the best results in the stability test. Blend 3 includes an overbased calcium sulphonate detergent manufactured in the presence of an amine-based friction modifier. Such improvements in stability are not observed for hybrids containing ester or amide-based friction modifiers.

The invention claimed is:

1. An overbased metal sulphonate detergent comprising at least one friction modifier having at least one amine group selected from: alkoxylated hydrocarbyl-substituted monoamines and diamines, and hydrocarbyl ether amines.

2. The overbased metal sulphonate detergent as claimed in claim 1, wherein the overbased metal sulphonate detergent is an overbased alkylbenzene sulphonate detergent.

3. The overbased metal sulphonate detergent as claimed in claim 1 wherein the friction modifier is selected from alkoxylated tallow amines and alkoxylated tallow ether amines.

4. The overbased metal sulphonate detergent as claimed in claim 3 wherein the friction modifier is selected from alkoxylated amines containing about two moles of alkylene oxide per mole of nitrogen.

5. The overbased metal sulphonate detergent as claimed in claim 1, wherein the friction modifier is selected from ethoxylated tallow amines and ethoxylated tallow ether amines.

6. The overbased metal sulphonate detergent as claimed in claim 1, wherein the friction modifier includes a linear hydrocarbyl group.

7. The overbased metal sulphonate detergent as claimed in claim 6, wherein the friction modifier includes a linear alkyl group.

8. The overbased metal sulphonate as claimed in claim 1, wherein the friction modifier is selected from the following two structures:

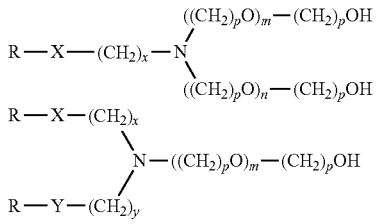

wherein R is a $C_6$ to $C_{28}$ alkyl group, X and Y are independently O or S or $CH_2$, x and y are independently 1 to 6, p is 2 to 4, and m and n are independently 0 to 5.

9. The overbased metal sulphonate as claimed in claim 8, wherein the friction modifier is selected from the following two structures:

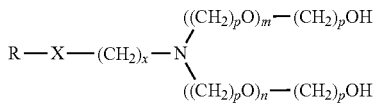

-continued

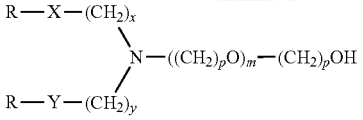

wherein R is a $C_{12}$ to $C_{25}$ alkyl group, X and Y are independently O or S or $CH_2$, x and y are independently 1 to 6, p is 2 to 4, and m and n are independently 0 to 5.

10. The overbased metal sulphonate as claimed in claim 8, wherein the friction modifier is selected from the following two structures:

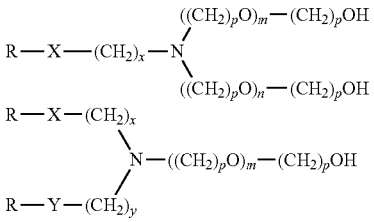

wherein R is a $C_6$ to $C_{28}$ alkyl group, X and Y are independently O or S or $CH_2$, x and y are independently 1 to 6, p is 2, and m and n are independently 0 to 5.

11. The overbased metal sulphonate as claimed in claim 8, wherein the friction modifier is selected from the following two structures:

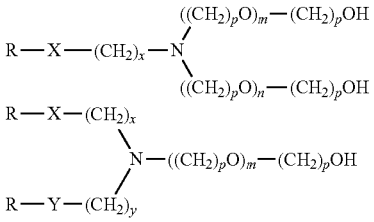

wherein R is a a $C_{12}$ to $C_{25}$ alkyl group, X and Y are independently O or S or $CH_2$, x and y are independently 1 to 6, p is 2, and m and n are independently 0 to 5.

12. A lubricating oil composition comprising oil of lubricating viscosity and the overbased metal sulphonate detergent as claimed in claim 1.

13. A method of preparing the overbased metal sulphonate detergent as claimed in claim 1; the method comprising the following steps:

providing a mixture of a alkyl arene sulphonic acid, a hydrocarbon solvent, an alcohol and a stoichiometric excess of an alkali metal or alkaline earth metal base (preferably calcium hydroxide) above that required to react with the sulphonic acid;

overbasing the mixture with an overbasing agent (preferably carbon dioxide); "heat-soaking" the mixture; and adding a friction modifier having at least one amine group to the mixture following the "heat-soaking" step.

14. The method of claim 13, wherein the alkali metal or alkaline earth metal base is calcium hydroxide, and the overbasing agent is carbon dioxide.

15. A method of reducing friction in an engine, the method comprising the step of lubricating the engine with the lubricating oil composition as claimed in claim 12.

16. An overbased metal sulphonate detergent obtained by providing a mixture of a alkyl arene sulphonic acid, a hydrocarbon solvent, an alcohol and a stoichiometric excess of an alkali metal or alkaline earth metal base above that required to react with the sulphonic acid;

overbasing the mixture with an overbasing agent;

"heat-soaking" the mixture; and adding a friction modifier having at least one amine group to the mixture following the "heat-soaking" step, wherein said friction modifier is selected from alkoxylated hydrocarbyl-substituted mono-amines and diamines, and hydrocarbyl ether amines.

* * * * *